United States Patent [19]

Kovar

[11] 4,122,647

[45] Oct. 31, 1978

[54] JOIST BRIDGING MEMBER

[76] Inventor: Paul J. Kovar, 4613 N. 53rd Dr., Phoenix, Ariz. 85031

[21] Appl. No.: 820,167

[22] Filed: Jul. 29, 1977

[51] Int. Cl.[2] ..... E04C 3/02

[52] U.S. Cl. ..... 52/695; 52/712

[58] Field of Search ..... 52/695, 696, 713, 317, 52/342, 693, 712

[56] References Cited

U.S. PATENT DOCUMENTS

| | | | |
|---|---|---|---|
| 459,900 | 9/1891 | Moore | 52/695 |
| 1,729,741 | 10/1929 | Heltzel | 52/695 |
| 1,867,449 | 7/1932 | Eckert et al. | 52/317 X |
| 2,914,816 | 12/1959 | Lundgren | 52/695 X |
| 2,964,807 | 12/1960 | Kennedy | 52/693 X |

*Primary Examiner*—Price C. Faw, Jr.
*Assistant Examiner*—Carl D. Friedman
*Attorney, Agent, or Firm*—Warren F. B. Lindsley

[57] ABSTRACT

A cross brace or bridging member for parallel structure beams, such as joists, studs, rafter trusses and the like which spaces and holds them in place relative to each other during assembly, and under normal building load conditions holds them in place longitudinally and prevents or greatly reduces lateral warpage or deflection thereof.

3 Claims, 10 Drawing Figures

JOIST BRIDGING MEMBER

DESCRIPTION OF THE PRIOR ART

Building braces have been used in the walls of buildings under construction to maintain the studs and trusses a distance apart and to strengthen the walls and ceiling anchored thereto under normal building loads and warping conditions.

U.S. Pat. No. 1,725,414 discloses a structural bracing member for spaced floor joists comprising a vertical portion arranged to be affixed to a joist and a bracing element extending from the bottom of the vertical portion. The top of the vertical portion is affixed to the end of a cooperating bracing element.

U.S. Pat. No. 1,742,045 discloses a brace bar having portions at one end for individually engaging different faces of the wooden studs against which the end of the bar is disposed.

U.S. Pat. No. 2,455,904 discloses an adjustable bridging member for building structures comprising a pair of brace arms pivotally connected to each other.

U.S. Pat. No. 2,865,059 discloses a horizontal bar connectable at its opposite ends to and extends transversely between adjacent joists. A second bar of inverted V-shape is connected at its apex to the midlength portion of the first bar and has short, horizontal extensions at its ends adapted to be secured to the bottom edges of the joists.

U.S. Pat. No. 2,914,816 discloses a bracing extending diagonally between adjacent joists and a fixed clamp for engaging the bracing elements in thrust relationship to the adjacent joists.

SUMMARY OF THE INVENTION

In accordance with the invention claimed an improved brace or bridging member is provided for connecting spaced joists, studs, rafter trusses and like parallel structural beams together.

It is, therefore, one object of this invention to provide an improved brace or bridging member which will aid the carpenter in parallelly arranging structural beams during assembly and will provide improved resistance to twisting under tension and stretching under load.

Another object of this invention is to provide an improved building brace which aligns and holds in place parallelly arranged juxtapositioned structural beams and prevents them from laterally distorting or deflecting.

A further object of this invention is to provide an improved bracing member which when used by the carpenter to position juxtapositioned structure beams also braces them for preventing lateral displacement including warping but does so with a relatively inexpensive bracing structure.

A still further object of this invention is to provide an improved bridging member which self spaces the parallel support members requiring no temporary lay-out or temporary bracing previous to installation.

A still further object of this invention is to provide an improved bridging member employing ears for placement over the tops of adjacent trusses for ease in installation.

It should be noted that throughout the description of the invention floor and ceiling joists, roof rafters, trusses, studding and the like will be included in the term "joists".

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawing in which.

DESCRIPTION OF THE PREFERRED EMBODIMENT

Figure 1:
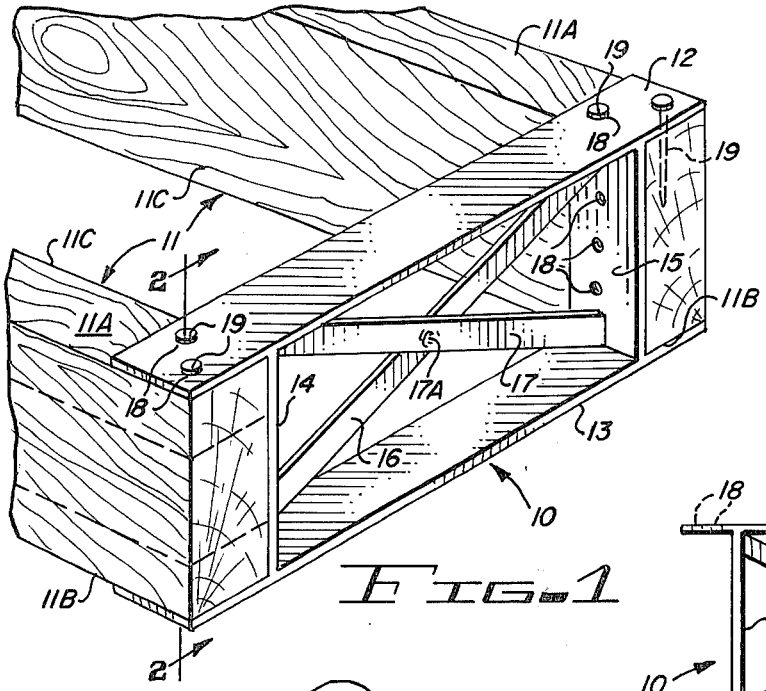
FIG. 1 is a perspective view of a bracing structure embodying the invention installed in place between two parallelly arranged structural beams.

Referring more particularly to the drawing by characters of reference, FIGS. 1–4 disclose a parallel structural beam bridging member or cross brace 10. This brace is used for bracing studs, rafters, trusses or joists 11 to hold them together and in place during building and when these structural elements receive floor, ceiling and wall boards the brace maintains them in place under building loads and stresses. As shown in dash lines in FIG. 1, the trusses may be flat or pitched members.

These braces are located wherever desired along the length of the joists and are usable to advantage in positioning on parallel beam relative to an adjacent beam during construction as well as to bridge these beams for proper weight distribution and to prevent the spread of the joists and warpage thereof under load conditions.

Figure 2:
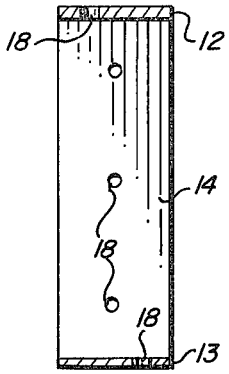
FIG. 2 is a cross-sectional view of FIG. 1 taken along the line 2—2.
Figure 3:
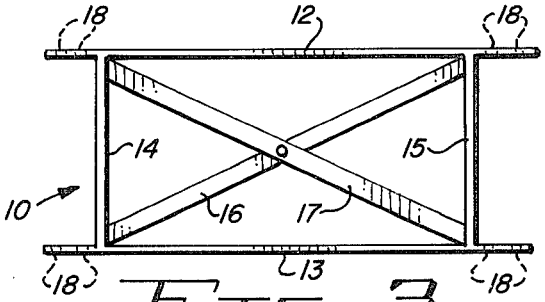
FIG. 3 is a plan view of the bracing structure shown in FIG. 1.

As shown in FIGS. 1–3, each cross brace 10 comprises a box shaped member having elongated top and bottom beam members 12 and 13 spacedly connected by two parallelly arranged spaced perpendicularly positioned members 14 and 15. Each cross brace further comprises a pair of arms 16 and 17 of substantially equal length assembled in face-to-face relationship in an X-shaped formation crossing at a mid point of their length at which point they may be suitably secured, if desired, such as by rivit 17A, welding, crimping etc. Each arm is preferably formed of a flat strip of material which is relatively narrow in relationship to its length and is correspondingly thin. As shown, each arm terminates at each of its ends in a corner formed by the intersection of top and bottom members 12 and 13 with the laterally positioned members 14 and 15.

Although the cross braces 10 may be formed of metal they also may be satisfactorily formed of a suitable plastic material.

Openings 18 are provided in each of the top and bottom members near their ends outside of the box like outline formed by the top and bottom members 12 and 13 and the lateral or perpendicular members 14 and 15. These openings as well as similar holes 18 in the perpendicular members 14 and 15 are provided for the passage of nails 19 or the like, one of which is shown in FIG. 1, into the beams to which the unit is to be secured, as shown in FIG. 1. The openings 18 are preferably disposed in more or less staggered relationship to each other thereby avoiding, as much as possible, the positioning of the nails or the like in rows which would tend to split the beam along the grain of the wood.

In its application, as shown in FIG. 1, each cross brace is placed between the beams 11 with the ends of the top and bottom members 12 and 13 extending over the tops and bottoms 11A and 11B of the joists. The cross brace then may be nailed securely to the joists from their top and later from their bottom surfaces, if so desired. Any extra length of the top and bottom members extending over the edges of the joist may be bent down against the vertical side 11C of the joist. Although this feature is not shown in the drawing, the technique is well known in the trade. If desired, the holes 18 may be in line with the ends of the top and bottom member shortened so that they end on the center line of the beam on which they rest.

As evident from FIG. 1, the cross braces 10 may be disposed in rows between the beams or joists or may be installed in any other suitable manner as required such as in a staggered relationship. Since the cross braces are formed of thin material they ensure that there will be no appreciable interference with the leveling of an overlying surface such as flooring, ceiling and walls. Equally important in the structure of FIGS. 1–3 is the characteristic that the perpendicular members 14 and 15 lie closely adjacent the sides 11C of the joists so that when the brace is places between the joists and nailed in place they not only hold one joist relative to the adjacent one at just the right distance apart but the members 14 and 15 hold and keep them from laterally twisting and warping. The arms 16 and 17 further aid in this feature of the cross brace but also aid in distributing between the joists the building loads and stress later encountered.

Figure 5:
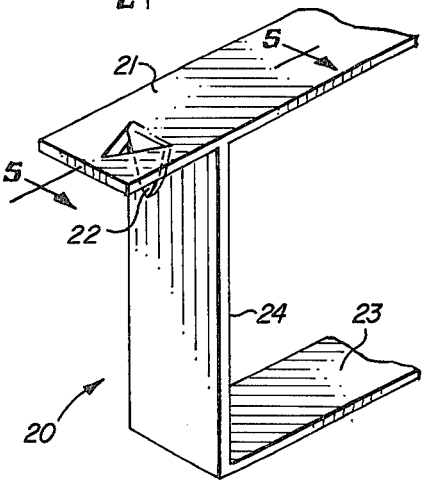
FIG. 5 is a partial perspective view of a modification of the bracing structural shown in FIGS. 1–4.
Figure 4:
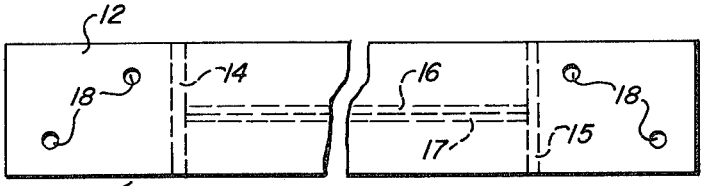
FIG. 4 is the top view of FIG. 3.
Figure 6:
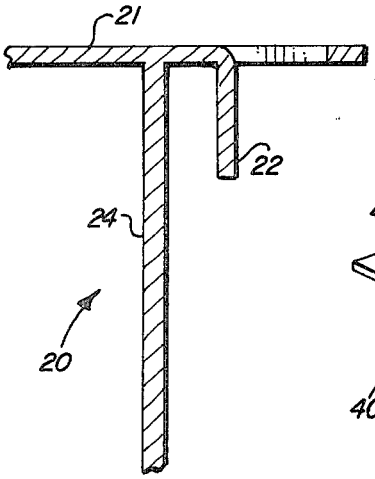
FIG. 6 is a cross-sectional view of FIG. 5 taken along the line 6—6.

FIGS. 5 and 6 disclose a modification of the cross brace structure shown in FIGS. 1–4 wherein the cross brace 20 comprises a top beam member 21 similar to top beam member 12 but having a trinagular knock out protrusion 22 serving as a nail for engaging the joist. In this instance the cross brace must be set down over adjacent joists and the like so that the bottom member 23 must terminate at the perpendicular member 24, as shown. In this instance two spaced perpendicular members 24 may be formed of a single piece of material.

Figure 7:
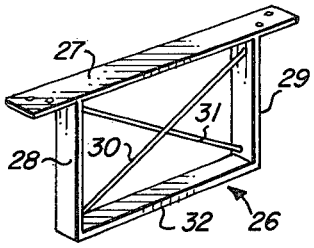
FIG. 7 is a perspective view of a further modification of the bracing structure shown in FIG. 1 but differs therefrom by eliminating the extending wings on the bottom horizontal member.

FIG. 7 illustrates a further modification of the cross braces, shown in FIGS. 1–6, wherein the cross brace 26 comprises a top beam member 27, perpendicular members 28 and 29, and cross arms 30 and 31 similar to that shown in FIGS. 1–4 but the bottom member 32 merely extends between the perpendicular members 28 and 29. This cross brace may be reversed for use with the bottom serving as the top etc. It also can be used by eliminating either the top or bottom member from the structure.

Figure 8:
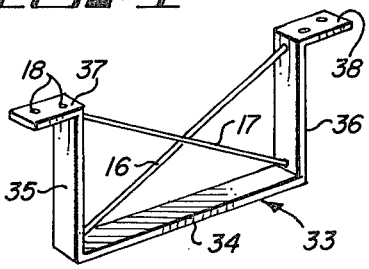
FIG. 8 is a still further modification of the bracing structures shown in FIGS. 1–7 wherein the top member of FIG. 1 is eliminated with wings laterally attached to the vertical legs of the structure and the bottom horizontal member formed without the end portions shown in FIG. 1.

FIG. 8 illustrates a further modification of the cross brace structure shown in FIGS. 1–7 wherein the cross brace 33 comprises an integral bottom beam member and perpendicular members 34, 35 and 36, respectively, wherein the ends of the perpendicular members terminate at each end in lateral outwardly extending plates or tabs 37, and 38 whose planes are disposed substantially at right angles to the plane of each perpendicular member for extending over the top surfaces of the joists 11. Each tab may have the usual nail holes 18 and cross arms 16 and 17 of the type shown in FIGS. 1–4. It should be noted that the bottom member 34 may be omitted as a further modification of the cross brace.

Figure 9:
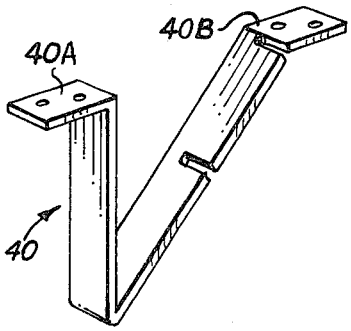
FIG. 9 illustrates a perspective view of a V-shaped brace forming a further modification of the structure shown in FIGS. 1–8.
Figure 10:
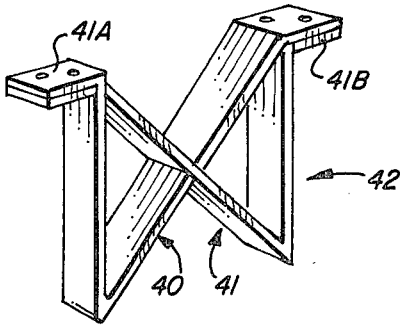
FIG. 10 illustrates a perspective view of structure brace formed from the interlocking of two of the V-shaped braces shown in FIG. 9.

FIG. 9 illustrates a V-shaped cross brace 40 which may be used individually or in combination, as shown in FIG. 10, with a similar cross brace 41 to form a composite interlocking cross brace 42.

Each of the V-shaped cross braces 40 and 41, one of which is a mirror image of the other, is provided with laterally extending tabs 40A, 40B, 41A and 41B at their ends which are provided with nail holes 18 for lying flat on top of adjacent joists. As shown each V-shaped cross brace is provided with a pair of slits 42 and 43 which interlock with similar slots of the mating V-shaped brace to form the unitary structure shown in FIG. 10.

With reference to FIG. 10, cross brace 42 may be formed of one integral member similar to FIG. 8 without the bottom member 34.

Although but a few embodiments of the present invention have been illustrated and described, it will be apparent to those skilled in the art that various changes and modifications may be made therein without departing from the spirit of the invention or from the scope of the appended claims.

What is claimed is:

1. An integral bridging element for interconnecting spaced parallelly arranged longitudinal structional members such as joists, roof rafters and studding comprising:

a pair of spaced parallelly arranged members, a cross brace disposed between and attached to the ends of each of said members, means extending laterally outwardly of at least one end of each of said members for extending over exterior edges of a pair of the structural member, aperture means in said means for use in affixing said means to the structural members, and a beam member extending between the other ends of said members, whereby the briding element spaces and holds the structural members in place relative to each other during assembly and substantially reduces lateral warpage or deflection under normal building loads.

2. An integral bridging element for interconnecting and applying supporting stress to spaced longitudinal juxtapositioned structural members such as joists, roof rafters and studding comprising:

a substantially rigid first beam member for fixedly securing to and being supported at its ends by the exterior edges of a pair of structural members, aperture means formed in the ends of said first beam member for aiding in securing it to each of the structural members, and a pair of spaced parallelly arranged support members extending laterally outwardly of said first beam member from the same side thereof one adjacent each end thereof, a cross brace disposed between and attached to each of said support members, said support members being juxtapositioned with the sides of each of the structural members, and a second beam member extending between the free ends of said support members, whereby the bridging element spaces and holds the structural members in place relative to each other during assembly and substantially reduces lateral warpage or deflection under normal building loads.

3. The bridging element set forth in claim 2 wherein:

the ends of said second beam member extend over the exterior edges of the structural members.

* * * * *